US008939731B2

(12) United States Patent
Zhou et al.

(10) Patent No.: US 8,939,731 B2
(45) Date of Patent: Jan. 27, 2015

(54) CHARACTER PARAMETERS OBTAINING METHOD FOR DISPLACEMENT CONTROL MECHANISM OF HYDRAULIC PUMP AND DETECTING DEVICE FOR CARRYING OUT THE METHOD

(75) Inventors: Xiang Zhou, Changsha (CN); Xianli Cao, Changsha (CN)

(73) Assignee: Hunan Sany Intelligent Control Equipment Co., Ltd., Changsha (CN)

( * ) Notice: Subject to any disclaimer, the term of this patent is extended or adjusted under 35 U.S.C. 154(b) by 132 days.

(21) Appl. No.: 13/139,710

(22) PCT Filed: Jun. 22, 2010

(86) PCT No.: PCT/CN2010/074233

§ 371 (c)(1),
(2), (4) Date: Jun. 14, 2011

(87) PCT Pub. No.: WO2011/003323

PCT Pub. Date: Jan. 13, 2011

(65) Prior Publication Data

US 2012/0134849 A1 May 31, 2012

(30) Foreign Application Priority Data

Jul. 6, 2009 (CN) ..... 2009 1 0158808

(51) Int. Cl.
*F04B 49/08* (2006.01)
*F15B 19/00* (2006.01)
(Continued)

(52) U.S. Cl.
CPC ..... *F15B 19/002* (2013.01); *F04B 49/002* (2013.01); *F04B 49/08* (2013.01);
(Continued)

(58) Field of Classification Search
CPC ..... F04B 49/08; F04B 2205/04; F15B 2211/6652
USPC ..... 417/38, 44.2, 53, 212, 222.2; 60/328, 60/445, 452; 702/45, 98, 100, 114, 138; 73/168
See application file for complete search history.

(56) References Cited

U.S. PATENT DOCUMENTS 4,886,422 A * 12/1989 Takeuchi et al. ..... 417/20
4,930,992 A * 6/1990 Takeuchi et al. ..... 417/20
(Continued)

FOREIGN PATENT DOCUMENTS

CN 1147847 A 4/1997
CN 1573133 A 2/2005
(Continued)

OTHER PUBLICATIONS

EP Application No. 10796700.2, European Search Report, Nov. 7, 2011, 22 pages.
(Continued)

*Primary Examiner* — Devon Kramer
*Assistant Examiner* — Nathan Zollinger
(74) *Attorney, Agent, or Firm* — Kilpatrick Townsend & Stockton LLP

(57) ABSTRACT

A character parameters obtaining method for a displacement control mechanism of a hydraulic pump and a detecting device for carrying out the method are disclosed. The method involves constructing a hydraulic system; outputting hydraulic energy by the hydraulic pump driven by a primary motor; detecting pressure of a displacement control mechanism; obtaining middle parameters by obtaining the time required for preset change of the pressure at the output end of the displacement control mechanism; obtaining character parameters of the displacement control mechanism according to the middle parameters. The method can obtain the character parameters of the displacement control mechanism by the pressure detection, so that the performance of the displacement control mechanism can be judged according to the obtained character parameters. The method avoids the need of obtaining the output flow of the hydraulic pump so as to eliminate the problem caused by using a flow meter or using an obliquity sensor to obtain the character parameters.

5 Claims, 4 Drawing Sheets

(51) Int. Cl.
*F04B 49/00* (2006.01)
*F15B 11/05* (2006.01)

(52) U.S. Cl.
CPC ..... *F04B 2205/04* (2013.01); *F15B 11/055* (2013.01); *F15B 2211/20553* (2013.01); *F15B 2211/25* (2013.01); *F15B 2211/6309* (2013.01); *F15B 2211/6316* (2013.01); *F15B 2211/6323* (2013.01); *F15B 2211/6333* (2013.01); *F15B 2211/6652* (2013.01)
USPC ..... 417/38; 417/44.2; 702/114

(56) References Cited

U.S. PATENT DOCUMENTS 5,059,097 A * 10/1991 Okazaki et al. ..... 417/222.2
6,202,411 B1 * 3/2001 Yamashita ..... 60/445
7,013,223 B1 * 3/2006 Zhang et al. ..... 702/34
8,548,661 B2 * 10/2013 Wu ..... 701/22
2014/0109999 A1 * 4/2014 Meissner et al. ..... 137/565.11

FOREIGN PATENT DOCUMENTS

CN 1587644 A 3/2005
CN 101410632 A 4/2009
CN 101608648 A 12/2009
DE 196 28 221 A1 4/1998
JP 56143803 A 11/1981
JP 2286885 A 11/1990
JP 2008 303813 A 12/2008

OTHER PUBLICATIONS

International Application No. PCT/CN2010/074233, International Search Report dated Sep. 16, 2010, 4 pages.

* cited by examiner

CHARACTER PARAMETERS OBTAINING METHOD FOR DISPLACEMENT CONTROL MECHANISM OF HYDRAULIC PUMP AND DETECTING DEVICE FOR CARRYING OUT THE METHOD

CROSS-REFERENCE TO RELATED APPLICATION

This application claims priority to International Application No. PCT/CN2010/074233, filed Jun. 22, 2011, titled "Character Parameters Obtaining Method for Displacement Control Mechanism of Hydraulic Pump and Detecting Device for Carrying Out the Method" which claims the benefit of Chinese patent application NO.200910158808.1, titled "Method for obtaining characteristic parameter of displacement control mechanism for hydraulic pump and measuring device thereof" and filed with the State Intellectual Property Office on Jul. 6, 2009, both of which are hereby incorporated by reference in their entirety.

FIELD OF THE INVENTION

The present disclosure relates to hydraulic measurement technology, and particularly to a method for obtaining a characteristic parameter of a displacement control mechanism for a hydraulic pump, the displacement control mechanism being used to adjust and control the displacement of the hydraulic pump; and to a measuring device for the displacement control mechanism for the hydraulic pump which implements the method.

BACKGROUND OF THE INVENTION

Generally, engineering machines are characterized by large transmit power, slow movement, wide speed range and complex control process, which, are the very advantages possessed by hydraulic transmission. As a result, hydraulic drive systems are widely used in the field of engineering machinery. Moreover, many full-hydraulic engineering machines have been developed, e.g., full-hydraulic excavators, full-hydraulic bulldozers, full-hydraulic cranes, full-hydraulic road graders, full-hydraulic road rollers, full-hydraulic spreading machines, and full-hydraulic forklift trucks.

A hydraulic system generally includes a hydraulic pump, a hydraulic valve and a hydraulic actuator. The hydraulic pump converts mechanical energy of a prime mover into hydraulic energy of a hydraulic fluid. The hydraulic valve adjusts the pressure, flow rate, and direction of the hydraulic fluid. The hydraulic actuator converts the hydraulic energy of the hydraulic fluid into mechanical energy, performs a corresponding action and completes a predetermined operation.

Due to the diversity of operating environments and demands, engineering machinery requires hydraulic systems to have predetermined control functions, e.g., constant power control function, pressure shut-off function, load-sensing function, self power control function, cross power control function, negative flow control function, and positive flow control function. According to their differences in basic control principles, control functions of hydraulic systems can be classified into: speed control functions, power control functions and energy-saving control functions.

In a hydraulic system, the speed at which the hydraulic actuator operates depends on the pressure that the hydraulic fluid gives and the output flow rate of the hydraulic pump, the output power of the hydraulic system is also related to the pressure in the hydraulic system and the output flow rate of the hydraulic pump. Because the pressure in the hydraulic system is determined by the load, the control of the speed at which the hydraulic actuator operates and the control of the output power of the hydraulic system are actually realized by controlling the output flow rate of the hydraulic pump. The basic idea of energy-saving control is to balance the supply and demand of flow rate, i.e., to adjust the output flow rate of the hydraulic pump so that the flow rate of the hydraulic fluid required by the hydraulic actuator is correctly met, thereby reducing useless output hydraulic energy and achieving energy saving in the hydraulic system. Therefore, energy saving control is also realized by controlling the output flow rate of the hydraulic pump. As can be seen, control functions of hydraulic systems depend on the control of the output flow rate of the hydraulic pump.

The output flow rate of a hydraulic pump is related to the pump shaft speed and the displacement. The pump shaft speed is provided by a prime mover. In the industry of engineering machinery, engines are widely used as the energy source. In order to extend the engine's service life and to reduce its fuel consumption, speed control of the diesel engine is generally used, i.e., to maintain the suction power of the engine substantially constant so that the speed of the engine remains substantially constant, thereby avoiding the engine being affected by load surge in the hydraulic system. Hence, in practice, the pump shaft speed of the hydraulic pump is maintained substantially constant. Therefore, the control of the output flow rate of a hydraulic pump is actually the control of its displacement.

To realize automatic and adaptive adjustment of the displacement of a hydraulic pump, normally a displacement control mechanism is used. The displacement control mechanism adjusts the displacement of the hydraulic pump according to pressure changes at the outlet of the hydraulic pump, to meet a predetermined requirement. The basic principle of the displacement control mechanism adjusting the displacement of the hydraulic pump is: the displacement control mechanism receives a signal representing the outlet pressure of the hydraulic pump, and drives a variable displacement mechanism of the hydraulic pump to perform a predetermined action according to the outlet pressure of the hydraulic pump, thereby realizing adjustment of the displacement of the hydraulic pump. Specific control functions of hydraulic systems may be different, but the basic control principles behind them are generally the same, except for the specific transfer function between the variable displacement mechanism and the outlet pressure of the hydraulic pump. The operating principle of the displacement control mechanism is described below, along with a constant power control function of a hydraulic system as an example.

In a hydraulic system with a constant power control function, the displacement control mechanism has an input connected to an outlet of a hydraulic pump, and an output connected to a variable displacement mechanism of the hydraulic pump. The variable displacement mechanism normally includes a variable displacement piston. According to pressure changes at the outlet of the hydraulic pump, the displacement control mechanism drives the variable displacement piston of the hydraulic pump to perform a predetermined action via a mechanical structure and a hydraulic circuit, e.g., an up stroke or a down stroke, causing an appropriate change in the swash-plate angle of the hydraulic pump, changing the displacement of the hydraulic pump, thereby realizing adjustment of the output flow rate of the hydraulic pump. When the outlet pressure of the hydraulic pump increases, the displacement of the hydraulic pump is reduced, so as to lower the output flow rate of the hydraulic pump; when the outlet pressure of the hydraulic pump decreases, the displacement of the hydraulic pump is increased, so as to raise the output flow rate of the hydraulic pump, thereby maintaining the output power of the hydraulic pump substantially constant, making the hydraulic energy output by the hydraulic system at a substantially constant rate, and realizing constant power control of the hydraulic system.

As can be seen, the performance of a control function of a hydraulic system mainly depends on the performance of the control of the hydraulic pump, which in turn depends on the performance of the displacement control mechanism. Accordingly, obtaining characteristic parameters of the displacement control mechanism, to find out the performance of the displacement control mechanism, is a key in realizing a specific control function of a hydraulic system.

For a hydraulic pump with a constant power control function, the performance of its displacement control mechanism can be evaluated by a curve describing the relationship between the output power of the hydraulic pump and the pressure in the hydraulic pump. If, as the pressure varies, the output power of the hydraulic pump remains substantially unchanged, then the performance of the displacement control mechanism is considered good; otherwise, the performance is considered bad.

The output power of a hydraulic pump is related to the outlet pressure and the output flow rate of the hydraulic pump. In order to evaluate the performance of the displacement control mechanism for the hydraulic pump, a pressure parameter and an output flow rate parameter have to be obtained. Similarly, in a hydraulic system with a speed control function and an energy-saving control function, the evaluation of characteristics of the displacement control mechanism for the hydraulic pump should also be based on a pressure parameter and an output flow rate parameter.

The outlet pressure parameter of a hydraulic pump can be measured by a pressure measuring device, and the output flow rate parameter of a hydraulic pump can be measured by a flow meter. Alternatively, we can measure the pump shaft speed of the hydraulic pump and the swash-plate angle of the hydraulic pump, and obtain the output flow rate parameter according to the relationship between the pump shaft speed, the swash-plate angle and the output flow rate of the hydraulic pump.

Currently, the precision, real-time performance, and cost of pressure measuring devices can meet the measuring requirements. However, the measurement of the output flow rate of the hydraulic pump is not satisfactory. Flow rate measurement by flow meters has a poor real-time performance and a long response time, normally tens or even hundreds of times longer than the response time of a pressure measuring device, which degrades the reliability of the obtained output flow rate parameter. Moreover, control precision of flow meters is far from satisfactory in measuring the displacement control mechanism, with a measurement error many times larger than pressure measuring devices. Therefore, the measurement of the output flow rate of a hydraulic pump by a flow meter is far from satisfactory in evaluating the characteristics of the displacement control mechanism. In addition, flow meters cost far more than pressure measuring devices, i.e., the cost of a flow meter is normally a dozens times more than a pressure sensor. If we obtain the output flow rate of a hydraulic pump by measuring the swash-plate angle of the hydraulic pump, a swash-plate angle sensor that meets the measuring precision requirement will cost tens of times more than a pressure measuring device.

Therefore, currently the output flow rate parameter can not be obtained with high precision and high reliability at a low cost; moreover, the precision and reliability of evaluation result of the performance of a displacement control mechanism based on the output flow rate parameter can not be ensured at a low cost.

SUMMARY OF THE INVENTION

Therefore, a basic objective of the present disclosure is to provide a method for evaluating the performance of a displacement control mechanism. The method evaluates the characteristics of the displacement control mechanism according to a time-domain response diagram of the pressure, thereby avoiding the problems above in obtaining the output flow rate parameter of the hydraulic pump.

To realize the method for evaluating the characteristics of a displacement control mechanism above, a first objective of the present disclosure is to provide a method for obtaining a characteristic parameter of a displacement control mechanism for a hydraulic pump. The method can obtain high-precision and high-reliability characteristic parameters of a displacement control mechanism at a low cost.

A second objective of the present disclosure is to provide a measuring device for a displacement control mechanism for a hydraulic pump, which implements the method above for obtaining a characteristic parameter of a displacement control mechanism for a hydraulic pump.

To achieve the first objective of the present disclosure, the present disclosure provides a method for obtaining a characteristic parameter of a displacement control mechanism for a hydraulic pump, wherein the displacement control mechanism has an input connected with an outlet of the hydraulic pump, has an output connected with a variable displacement mechanism of the hydraulic pump, and is adapted to control a displacement of the hydraulic pump according to a pressure at the outlet of the hydraulic pump, the method includes:

constructing a hydraulic system so that the hydraulic pump, driven by a prime mover, outputs hydraulic energy;

measuring a pressure and obtaining an intermediate parameter, the measuring a pressure including measuring a pressure at the output of the displacement control mechanism, and the obtaining an intermediate parameter including obtaining the time required for the pressure at the output of the displacement control mechanism to have a predetermined change; and obtaining a characteristic parameter of the displacement control mechanism, obtaining a characteristic parameter of the displacement control mechanism according to the intermediate parameter.

Preferably, the measuring a pressure includes: measuring the pressure at the outlet of the hydraulic pump; and the obtaining an intermediate parameter includes: obtaining the time required for the pressure at the outlet of the hydraulic pump to have a predetermined change.

Optionally, the obtaining an intermediate parameter includes: obtaining the time T1 required for the pressure at the output of the displacement control mechanism to start rising, and the time T2 required for the pressure at the output to reach a stable state; and the obtaining a characteristic parameter of the displacement control mechanism includes: obtaining an operation time parameter $T_D$ of the displacement control mechanism, where $T_D$=T2−T1.

Optionally, the obtaining an intermediate parameter includes: obtaining the time T3 required for the pressure at the outlet of the hydraulic pump to start rising; and the obtaining a characteristic parameter of the displacement control mechanism includes: obtaining a delay time parameter $T_Y$ of the displacement control mechanism, where $T_Y$=T1−T3.

Optionally, the obtaining a characteristic parameter of the displacement control mechanism includes: obtaining a response time parameter $T_X$ of the displacement control mechanism, where $T_X=T_D+T_Y$, or $T_X=T2-T3$.

Preferably, the obtaining a characteristic parameter of the displacement control mechanism further includes: obtaining a characteristic parameter of the displacement control mechanism according to the pressure obtained by the measuring.

Optionally, the obtaining a characteristic parameter of the displacement control mechanism includes: obtaining a stable control pressure $P_W$ of the displacement control mechanism and an oscillation amplitude $P_M$ of the stable control pressure $P_W$, the stable control pressure PW equals to the pressure at the output of the displacement control mechanism when it reaches a stable state.

To achieve the second objective of the present disclosure, the present disclosure provides a measuring device for a displacement control mechanism for a hydraulic pump, which implements the method above, wherein, the device includes a prime mover, a loading device and a first pressure measuring device; the prime mover is adapted to drive the hydraulic pump, the loading device is connected with an outlet of the hydraulic pump to form a load of the hydraulic pump, and the first measuring device is connected with an output of the displacement control mechanism.

Preferably, the measuring device further includes a second pressure measuring device, the second pressure measuring device being connected with the outlet of the hydraulic pump.

Preferably, the measuring device further includes a processing device, the processing device being adapted to receive pressure signals output by the first pressure measuring device and the second pressure measuring device, and to output a time-domain response diagram of the pressures according to the pressure signals and the time for the pressure signals to change.

Compared with the prior art, with the method provided by the present disclosure for obtaining a characteristic parameter of a displacement control mechanism for a hydraulic pump, the intermediate parameter can be obtained by simply measuring a pressure, and the characteristic parameter of the displacement control mechanism can be determined according to the intermediate parameter. Then, the performance of the displacement control mechanism can be evaluated according to the obtained characteristic parameter of the displacement control mechanism. This method does not need to directly obtain the output flow rate of the hydraulic pump, hence, the low precision and degraded reliability problems due to the use of a flow meter can be avoided, and the high cost problem due to the use of a swash-plate angle sensor may be avoided. As described in the background of the invention, obtaining the characteristic parameter of the displacement control mechanism for the hydraulic pump by measuring a pressure has more advantages: firstly, pressure measurement has a good real-time performance, hence the obtained characteristic parameter of the displacement control mechanism also has a synchronized response, improving the reliability of the characteristic parameter of the displacement control mechanism; secondly, pressure measurement has a high precision, hence the obtained characteristic parameter of the displacement control mechanism also has a high precision. Therefore, the precision of the evaluation result for the displacement control mechanism based on the characteristic parameter of the displacement control mechanism can be ensured, thereby providing a reliable reference for realizing the control function of the hydraulic system.

In a further technical solution, the pressure at the outlet of the hydraulic pump is also measured, and the characteristic parameter of the displacement control mechanism is obtained according to the pressure at the outlet of the hydraulic pump and the pressure at the output of the displacement control mechanism; by measuring pressures at the two locations, more characteristic parameters of the displacement control mechanism can be obtained. Furthermore, a more detailed and more accurate evaluation can be made based on these characteristic parameters to the displacement control mechanism.

In a further technical solution, the sensitiveness of the displacement control mechanism can be determined by obtaining the delay time parameter of the displacement control mechanism, the operation speed of the displacement control mechanism can be determined by obtaining the operation time and response time of the displacement control mechanism, and the stability and reliability of the displacement control mechanism can be determined by obtaining the oscillation amplitude of the stable control pressure of the displacement control mechanism.

The measuring device for a displacement control mechanism for a hydraulic pump provided by the present disclosure implements the method above for obtaining a characteristic parameter of a displacement control mechanism for a hydraulic pump, and has corresponding technical effects.

DETAILED DESCRIPTION OF THE INVENTION

The present disclosure will be described hereinafter in details in conjunction with the accompanying drawings. The description herein is for exemplary and illustrative purposes only, and should not be interpreted as limiting the scope of the present disclosure.

For descriptive convenience, the method for obtaining a characteristic parameter of a displacement control mechanism for a hydraulic pump is described along with the structure and operating principle of the measuring device for a displacement control mechanism for a hydraulic pump, and the method for obtaining a characteristic parameter of a displacement control mechanism for a hydraulic pump will not be described again separately.

Figure 1:
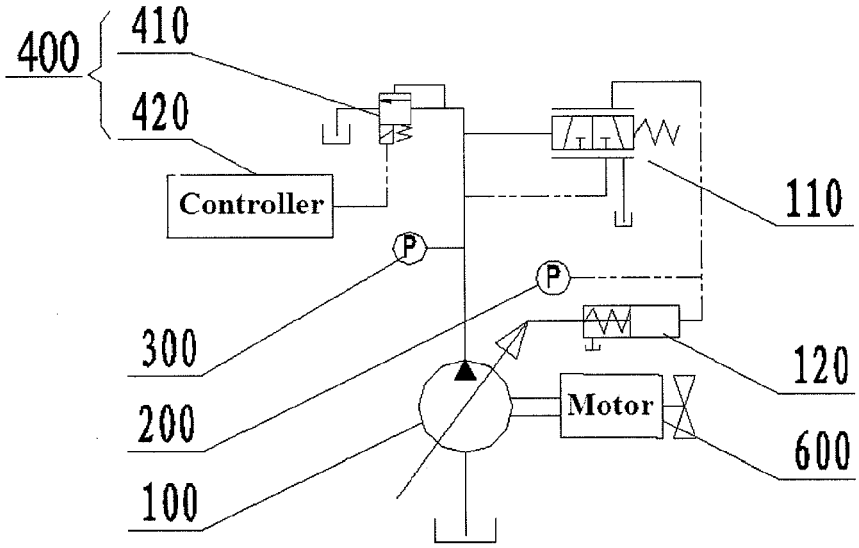
FIG. 1 illustrates the principle of a measuring device for a displacement control mechanism for a hydraulic pump according to a first embodiment of the present disclosure.

Now refer to FIG. 1, which illustrates the principle of a measuring device for a displacement control mechanism for a hydraulic pump according to a first embodiment of the present disclosure.

The measuring device for a displacement control mechanism for a hydraulic pump according to the first embodiment includes: a prime mover 600, a loading device 400, a first pressure measuring device 200 and a second pressure measuring device 300. FIG. 1 also shows a hydraulic pump 100 to be measured, and the hydraulic pump 100 has a displacement control mechanism 110 and a variable displacement mechanism 120. The displacement control mechanism 110 has an input connected with an outlet of the hydraulic pump, and an output connected with the variable displacement mechanism 120. As shown in FIG. 1, the displacement control mechanism is a 3 port 2 position control valve situated in a flow path between the output of the displacement control mechanism and the outlet of the hydraulic pump. The prime mover 600 is used to drive the hydraulic pump 100. The loading device 400 is connected with the outlet of the hydraulic pump, forming the load of the hydraulic pump 100. The first pressure measuring device 200 and the second pressure measuring device 300 are connected with the output of the displacement control mechanism 110 and the outlet of the hydraulic pump respectively, to measure the pressure at the output of the displacement control mechanism and the pressure at the outlet of the hydraulic pump.

In this embodiment, the hydraulic pump 100 is a swash-plate variable displacement pump, and the variable displacement mechanism 120 includes a variable displacement cylinder. The reciprocating motion of the variable displacement cylinder changes the swash-plate angle of the hydraulic pump 100, thereby realizing adjustment of the displacement of the hydraulic pump 100. The prime mover 600 is a motor, which drives the hydraulic pump 100. The loading device 400 includes an electrical proportional relief valve 410 and a controller 420. The electrical proportional relief valve 410 changes its crack pressure according to an electrical signal input by the controller 420, to change the load of the hydraulic pump 100, thereby realizing control and adjustment of the pressure at the outlet of the hydraulic pump. Using the electrical proportional relief valve to form the load of the hydraulic pump 100 can improve the adaptability of the measuring device for the displacement control mechanism for the hydraulic pump, which enables the measuring device to measure the performance of various kinds of hydraulic pumps. In the operation process described below, the crack pressure of the electrical proportional relief valve 410 is maintained at a predetermined value to form a predetermined load of the hydraulic pump 100.

Figure 2:
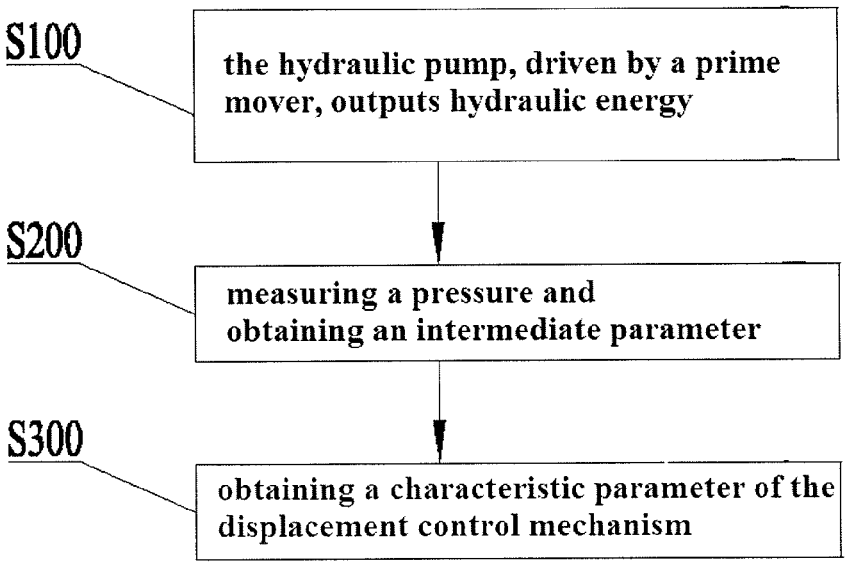
FIG. 2 is a flow chart of the operation of measuring device for a displacement control mechanism for a hydraulic pump according to the first embodiment, and also a flow chart of a method for obtaining a characteristic parameter of a displacement control mechanism for a hydraulic pump.

Now refer to FIG. 2, a flow chart of the operation of measuring device for a displacement control mechanism for a hydraulic pump according to the first embodiment, and also a flow chart of a method for obtaining a characteristic parameter of a displacement control mechanism for a hydraulic pump.

The method for obtaining a characteristic parameter of a displacement control mechanism for a hydraulic pump includes the following steps:

S100, a hydraulic system is constructed so that the hydraulic pump 100, driven by the prime mover 600, outputs hydraulic energy. The purpose of constructing the hydraulic system is to simulate an operating environment for the hydraulic pump 100, and further obtain the characteristic parameter of the displacement control mechanism 110 in the simulated operating environment.

S200, a pressure is measured and an intermediate parameter is obtained. The measuring of a pressure includes: measuring the pressure at the output of the displacement control mechanism 110 by the first pressure measuring device 200, and measuring the pressure at the outlet of the hydraulic pump by the second pressure measuring device 300. And, an intermediate parameter is obtained according to the change of the pressure, which includes: obtaining an intermediate parameter according to the change of the pressure at the outlet of the hydraulic pump, and obtaining an intermediate parameter according to the change of the pressure at the output of the displacement control mechanism 110.

Figure 3:
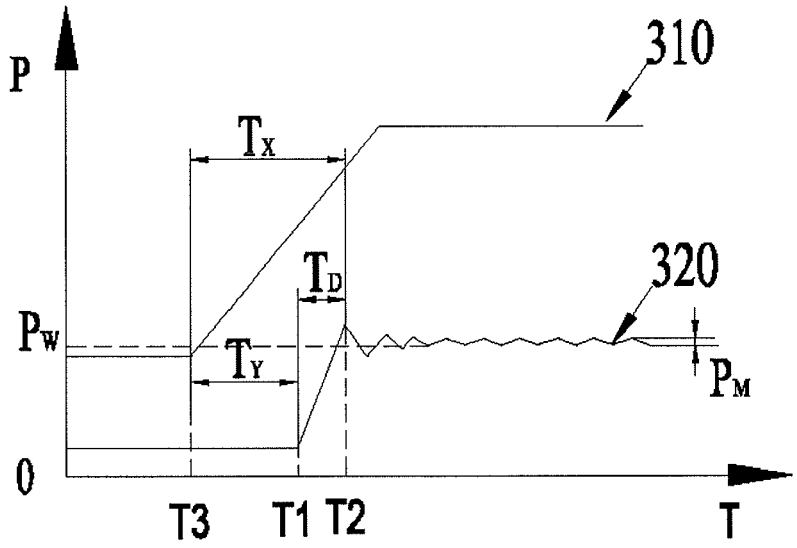
FIG. 3 illustrates a time-domain response diagram of the pressures based on the relationship between pressures and time measured by a first pressure measuring device and a second pressure measuring device.

In this embodiment, the first pressure measuring device 200 and the second pressure measuring device 300 are pressure gauges. In obtaining of the intermediate parameter, the predetermined intermediate parameter can be determined according to data and time displayed on the pressure gauges, or according to a time-domain response diagram of the pressures based on the relationship between pressures and time. Now refer to FIG. 3, a time-domain response diagram of the pressures based on the relationship between pressures and time measured by the first pressure measuring device 200 and the second pressure measuring device 300. In FIG. 3, the horizontal axis represents time T, and the vertical axis represents pressure P; line 310 is a curve describing the pressure changes with time as obtained by the second pressure measuring device 300, and line 320 is a curve describing the pressure changes with time as obtained by the first pressure measuring device 200. A plurality of intermediate parameters can be obtained based on the pressure curves in FIG. 3, e.g. the time T1 required for the pressure at the output of the displacement control mechanism 110 to start rising, the time T2 required for the pressure at the output to reach a substantially stable state, and the time T3 required for the pressure at the outlet of the hydraulic pump to start rising.

S300, a characteristic parameter of the displacement control mechanism 110 is obtained, i.e., a characteristic parameter of the displacement control mechanism 110 is obtained according to the intermediate parameter. The characteristic parameter of the displacement control mechanism 110 may be obtained by various specific methods. As shown in FIG. 3, according to the time T1 required for the pressure at the output of the displacement control mechanism 110 to start rising and the time T2 required for the pressure at the output to reach a substantially stable state, an operation time parameter $T_D$ of the displacement control mechanism 110 can be obtained, where $T_D$=T2−T1, which represents the time required for the displacement control mechanism 110 from starting to adjust the displacement of the hydraulic pump 100 to the end of the adjustment, to evaluate the adjustment speed of the displacement control mechanism 110. Moreover, according to the time T3 required for the pressure at the outlet of the hydraulic pump to start rising and the time T1 required for the pressure at the output of the displacement control mechanism 110 to start rising, a delay time parameter $T_Y$ of the displacement control mechanism 110 can be obtained, where $T_Y$=T1−T3, which represents the sensitiveness of the displacement control mechanism 110. Furthermore, according to the delay time parameter $T_Y$ and the operation time parameter $T_D$, a response time parameter $T_X$ of the displacement control mechanism 110 can be obtained, where $T_X=T_D+T_Y$; or, according to the time T3 required for the pressure at the outlet of the hydraulic pump to start rising and the time T2 required for the pressure at the output of the displacement control mechanism 110 to reach a substantially stable state, the response time $T_X$ can also be obtained where $T_X$=T2−T3, which represents the sensitiveness and displacement control performance of the displacement control mechanism 110.

Now refer to FIG. 3, by using the measuring device for a displacement control mechanism for a hydraulic pump according to the embodiment, a stable control pressure $P_W$ of the displacement control mechanism 110 can be obtained according to the first pressure measuring device 200. It can be understood that, the stable control pressure $P_W$ equals to the pressure at the output of the displacement control mechanism 110 when it reaches a substantially stable state. In addition, the skilled in the art will understand that, as a relatively stable value, the stable control pressure $P_W$ may have a certain oscillation. Its oscillation amplitude represents the control performance of the displacement control mechanism 110. Therefore, according to the range of the stable control pressure $P_W$, the oscillation amplitude $P_M$ of the stable control pressure can be obtained, thereby enriching the obtained characteristic parameters of the displacement control mechanism 110, and opening more aspects in the evaluation of the performance of the displacement control mechanism. It can be understood that, more parameters can be obtained according to the time-domain response diagram of the pressures shown in FIG. 3, e.g., a relationship between the stable pressure at the outlet of the hydraulic pump and the stable control pressure $P_W$ at the output of the displacement control mechanism 110, or a relationship between the peak value of the control pressure of the displacement control mechanism 110 and the stable control pressure $P_W$. According to these parameters, the performance of the displacement control mechanism 110 can be evaluated in more aspects, which is helpful for better understanding and evaluation of the performance of the displacement control mechanism 110.

It can be understood that, this method does not need to directly obtain the output flow rate of the hydraulic pump 100, hence, the problems due to the use of a flow meter or a swash-plate sensor to obtain the output flow rate of the hydraulic pump can be avoided. As described in the background of the invention, obtaining the characteristic parameter of the displacement control mechanism 110 by the first pressure measuring device 200 and the second pressure measuring device 300 has more advantages: firstly, pressure measurement has a good real-time performance, e.g. the delay can be as low as 4 ms, hence the obtained characteristic parameter of the displacement control mechanism also has a synchronized response and high reliability; secondly, pressure measurement has a high precision, hence the characteristic parameter of the displacement control mechanism 110 obtained by the method also has a high precision. Furthermore, the precision of the evaluation result for the displacement control mechanism 110 based on the characteristic parameter of the displacement control mechanism can be ensured. Meanwhile, the cost of pressure measurement is low, thereby greatly reducing the cost of the measuring device for a displacement control mechanism for a hydraulic pump and the cost of evaluation of the displacement control mechanism 110. To sum up, the measuring device for a displacement control mechanism for a hydraulic pump and the method for obtaining a characteristic parameter of a displacement control mechanism for a hydraulic pump above can obtain a more accurate and more reliable characteristic parameter at a low cost, and ensures the reliability of the evaluation of the displacement control mechanism 110.

Figure 4:
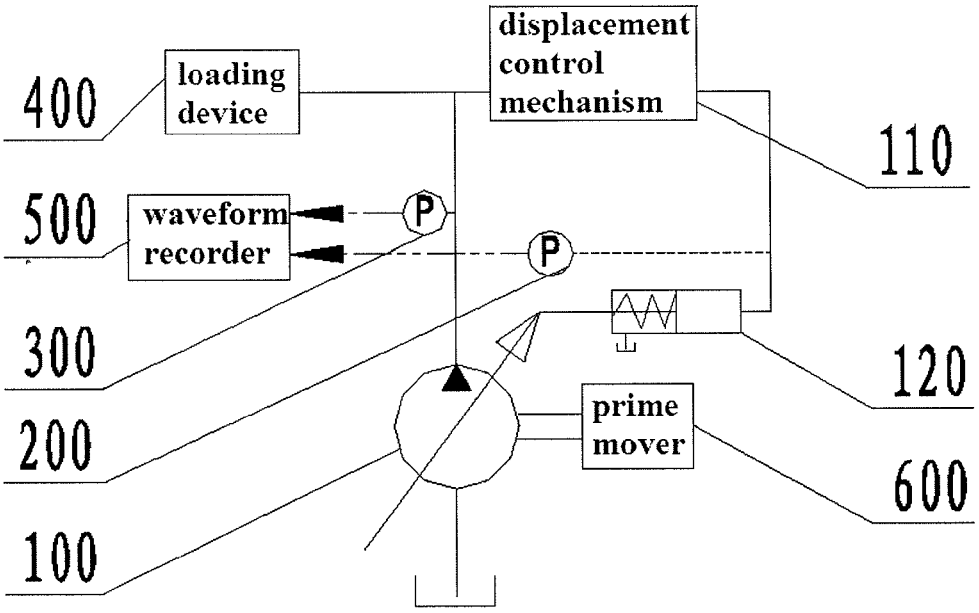
FIG. 4 illustrates the principle of a measuring device for a displacement control mechanism for a hydraulic pump according to a second embodiment of the present disclosure.

To obtain the intermediate parameter and the characteristic parameter of the displacement control mechanism 110 more conveniently, an appropriate waveform recorder can be used to receive pressure signals output by the pressure measuring devices, and to perform predetermined processing of the pressure signals. Now refer to FIG. 4, which illustrates the principle of a measuring device for a displacement control mechanism for a hydraulic pump according to a second embodiment of the present disclosure.

The measuring device for a displacement control mechanism for a hydraulic pump according to the second embodiment of the present disclosure includes: a prime mover 600, a loading device 400, a first pressure measuring device 200 and a second pressure measuring device 300. In addition, comparing with the first embodiment, a waveform recorder 500 is added, and pressure sensors are used as the first measuring device 200 and the second measuring device 300. The waveform recorder 500 is connected with the first measuring device 200 and the second measuring device 300; and while measuring the pressures, the first measuring device 200 and the second measuring device 300 transmit pressure signals to the waveform recorder 500.

Figure 5:
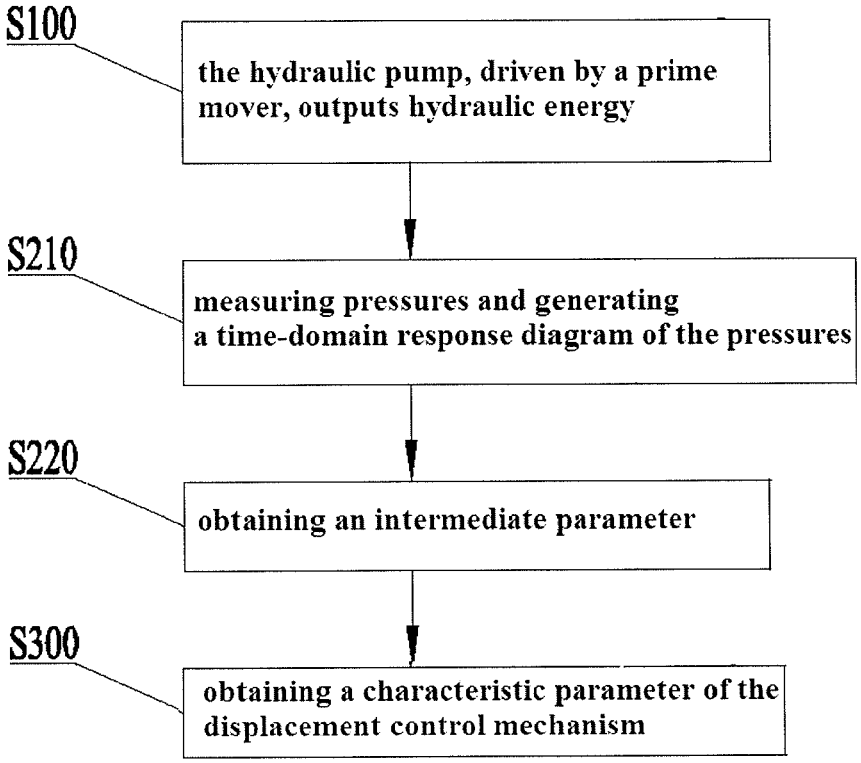
FIG. 5 is a flow chart of a measuring device for a displacement control mechanism for a hydraulic pump according to the second embodiment of the present disclosure obtaining a characteristic parameter of a displacement control mechanism for a hydraulic pump.

As shown in FIG. 5, a flow chart of a measuring device for a displacement control mechanism for a hydraulic pump according to the second embodiment of the present disclosure obtaining a characteristic parameter of a displacement control mechanism for a hydraulic pump, the method includes the following steps:

S100, a hydraulic system is constructed so that the hydraulic pump 100, driven by the prime mover 600, outputs hydraulic energy.

S210, pressures are measured, and the waveform recorder 500 generates a time-domain response diagram of the pressures according to the pressure signals. This step differs from the first embodiment in that: the waveform recorder 500 has a timing function, and automatically generates a time-domain response diagram of the pressures according to the pressure signals output by the first pressure measuring device 200 and the second pressure measuring device 300.

S220, an intermediate parameter is obtained, i.e. an intermediate parameter is obtained according to the time-domain response diagram of the pressures generated by the waveform recorder 500. Because the time-domain response diagram of the pressures generated by the waveform recorder 500 has a higher precision, the intermediate parameter obtained also has a higher precision. The specific methods for obtaining the intermediate parameter may be the same as those of the first embodiment and are omitted here. Similarly, more predetermined intermediate parameter can be obtained according to actual needs.

S300, a characteristic parameter of the displacement control mechanism is obtained, i.e., a characteristic parameter of the displacement control mechanism 110 is obtained according to the intermediate parameter. This step may be the same as that of the first embodiment and is omitted here.

It can be understood that, by using the time-domain response diagram of the pressures as shown in FIG. 3 output by the waveform recorder 500 according to the pressure signals, the intermediate parameter can be obtained visually, and the obtaining of the characteristic parameter of the displacement control mechanism can be more convenient and fast. It can be understood that, in order to improve the automation of the measuring device for a displacement control mechanism for a hydraulic pump, and to improve the efficiency of measurement, other processing devices with automatic processing functions may further be used. After receiving the pressure signals output by the first pressure measuring device 200 and the second pressure measuring device 300, a processing device may automatically process according to the pressure signals received and the time required for the pressure at a predetermined end to have a predetermined change, and automatically obtain and output the characteristic parameter of the displacement control mechanism 110.

Figure 6:
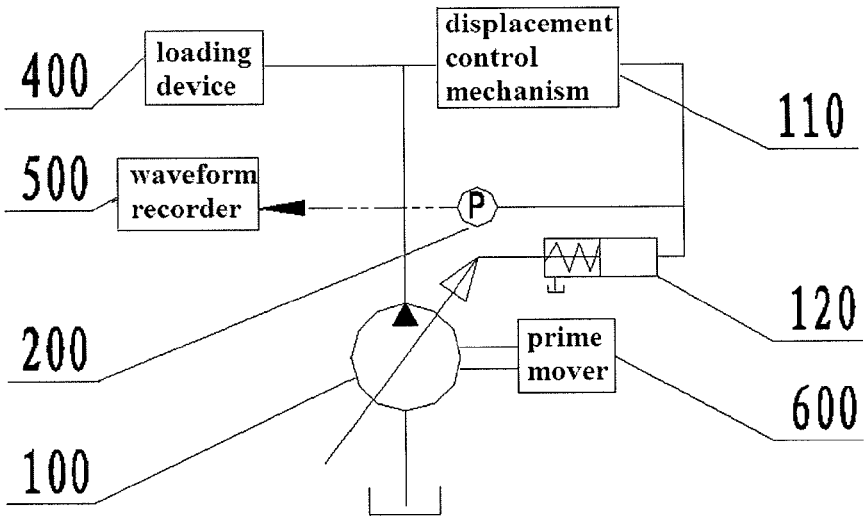
FIG. 6 illustrates the principle of a measuring device for a displacement control mechanism for a hydraulic pump according to a third embodiment of the present disclosure.

In some cases, the predetermined intermediate parameter can be obtained by using only one pressure measuring device. Now refer to FIG. 6, which illustrates the principle of a measuring device for a displacement control mechanism for a hydraulic pump according to a third embodiment of the present disclosure.

Figure 7:
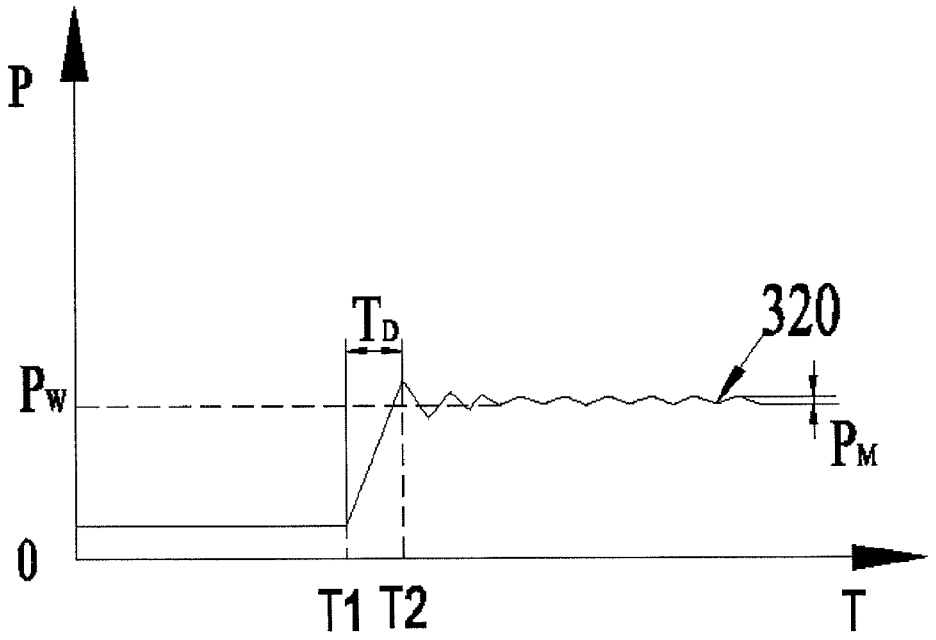
FIG. 7 illustrates a time-domain response diagram of the pressure at the output of the displacement control mechanism obtained by a measuring device for a displacement control mechanism for a hydraulic pump according to the third embodiment of the present disclosure.

The measuring device for a displacement control mechanism for a hydraulic pump according to the third embodiment of the present disclosure includes: a prime mover 600, a loading device 400, a waveform recorder 500, a first pressure measuring device 200, and a displacement control mechanism 110 (such as the valve depicted in FIG. 1) situated in a flow path between the output of the displacement control mechanism and the outlet of the hydraulic pump. In this embodiment, the measuring device for a displacement control mechanism for a hydraulic pump includes the first pressure measuring device 200 only, and the other structures are the same as the measuring device for a displacement control mechanism for a hydraulic pump according to the second embodiment. Therefore, according to the pressure signal output by the first pressure measuring device 200, the waveform recorder 500 can only generate a time-domain response diagram of the pressure at the output of the displacement control mechanism 110. Now refer to FIG. 7, which illustrates a time-domain response diagram of the pressure at the output of the displacement control mechanism obtained by a measuring device for a displacement control mechanism for a hydraulic pump according to the third embodiment of the present disclosure. According to the time-domain response diagram of the pressure, the time T1 required for the pressure at the output of the displacement control mechanism 110 to start rising and the time T2 required for the pressure to reach a substantially stable state can still be obtained. According to T1 and T2, the operation time parameter $T_D$ of the displacement control mechanism 110 can be obtained, as well as the stable control pressure $P_W$ of the displacement control mechanism and the oscillation amplitude $P_M$ of the stable control pressure. Therefore, the performance of the displacement control mechanism 110 can be evaluated according to these characteristic parameters. It can be understood that, the pressure at the output of the displacement control mechanism 110 may be measured by using a pressure gauge, and a predetermined intermediate parameter can be obtained directly according to the relationship between pressure changes and time; or, a time-domain response diagram of the pressure can be drawn according to the relationship between pressure changes and time, and then the intermediate parameter is obtained.

Preferred embodiments of the present disclosure are described above. It should be noted that a variety of alternations and modifications can be made by those skilled in the art without departing from the scope of the present disclosure. Hence, these alternations and modification should fail within the scope of the present disclosure.

The invention claimed is:

1. A method for obtaining a characteristic parameter of a displacement control mechanism for a hydraulic pump, wherein, the displacement control mechanism has an input connected with an outlet of the hydraulic pump, has an output connected with a variable displacement mechanism of the hydraulic pump, and is adapted to control a displacement of the hydraulic pump according to pressure at the outlet of the hydraulic pump, the method comprises:

constructing a hydraulic system so that the hydraulic pump, driven by a prime mover, outputs hydraulic energy;

measuring a pressure and obtaining an intermediate parameter, the measuring the pressure comprising measuring the pressure at the output of the displacement control mechanism, and the obtaining the intermediate parameter comprising obtaining the time required for the pressure at the output of the displacement control mechanism, the displacement control mechanism situated in a flow path between the output of the displacement control mechanism and the outlet of the hydraulic pump to have a predetermined change; and obtaining the characteristic parameter of the displacement control mechanism according to the intermediate parameter, wherein the obtaining of the intermediate parameter comprises:

obtaining the time $T_1$ required for the pressure at the output of the displacement control mechanism to start rising, and the time $T_2$ required for the pressure at the output of the displacement control device to reach a stable state; and wherein the obtaining of the characteristic parameter of the displacement control mechanism comprises:

obtaining an operation time parameter $T_D$ of the displacement control mechanism, where $T_D=T_2-T_1$.

2. The method for obtaining a characteristic parameter of a displacement control mechanism for a hydraulic pump according to claim 1, further comprising measuring a pressure at the outlet of the hydraulic pump; and the obtaining the intermediate parameter further comprises obtaining the time required for the pressure at the outlet of the hydraulic pump to have a predetermined change.

3. The method for obtaining a characteristic parameter of a displacement control mechanism for a hydraulic pump according to claim 2, wherein, the obtaining the intermediate parameter comprises: obtaining the time $T_3$ required for the pressure at the outlet of the hydraulic pump to start rising; and the obtaining the characteristic parameter of the displacement control mechanism comprises: obtaining a delay time parameter $T_Y$ of the displacement control mechanism, where $T_Y=T_1-T_3$.

4. The method for obtaining a characteristic parameter of a displacement control mechanism for a hydraulic pump according to claim 3, wherein, the obtaining a characteristic parameter of the displacement control mechanism comprises: obtaining a response time parameter $T_X$ of the displacement control mechanism, where $T_X=T_D+T_Y$, or $T_X=T_2-T_3$.

5. The method for obtaining a characteristic parameter of a displacement control mechanism for a hydraulic pump according to claim 1, wherein, the obtaining the characteristic parameter of the displacement control mechanism comprises: obtaining a stable control pressure $P_W$ of the displacement control mechanism and an oscillation amplitude $P_M$ of the stable control pressure $P_W$, the stable control pressure $P_W$ equals the pressure at the output of the displacement control mechanism when it reaches a stable state.

* * * * *